US005112358A

United States Patent [19]

Deal, III

[11] Patent Number: 5,112,358

[45] Date of Patent: May 12, 1992

[54] METHOD OF CLEANING HEAVILY SOILED TEXTILES

[75] Inventor: James F. Deal, III, Fernandina Beach, Fla.

[73] Assignee: Paradigm Technology Co., Inc., Fernandina Beach, Fla.

[21] Appl. No.: 462,657

[22] Filed: Jan. 9, 1990

[51] Int. Cl.[5] ..... D06L 1/22

[52] U.S. Cl. ..... 8/137; 134/26

[58] Field of Search ..... 8/137, 139.1; 252/162; 134/26

[56] References Cited

U.S. PATENT DOCUMENTS

| | | | |
|---|---|---|---|
| 3,701,627 | 10/1972 | Grunewalder | 8/139.1 |
| 4,362,638 | 12/1982 | Caskey et al. | 8/139.1 |
| 4,414,128 | 11/1983 | Goffinet | 252/106 |
| 4,861,385 | 8/1989 | Yagishita | 134/26 |

*Primary Examiner*—Prince Willis, Jr.
*Assistant Examiner*—John F. McNally
*Attorney, Agent, or Firm*—Mason, Kolehmainen, Rathburn & Wyss

[57] ABSTRACT

Heavily soiled shop towels, mops and other industrial laundry are initially contacted with a mixture of a cleaning solvent and an emulsifier to efficiently penetrate the industrial soil in the fabric. Thereafter water is added to provide an oil-in-water emulsion cleaning composition which effectively removes both the industrial soil and the solvent from the goods. A preferred class of hydrocarbon solvents suitable for this purpose is the class of solvents known as terpene solvents. Particularly suitable are terpene solvents having a tagg closed cup flash point, of 140° F. or higher. The oil-in-water emulsion thereafter is demulsified for separation of the cleaning solvent from the water and recycle of the solvent to the process.

21 Claims, 1 Drawing Sheet

METHOD OF CLEANING HEAVILY SOILED TEXTILES

FIELD OF THE INVENTION

The present invention is directed to a method of cleaning heavily soiled fabrics such as shop towels, mops and other heavily soiled industrial laundry. More particularly, the present invention is directed to a method of cleaning shop towels, mops and other heavily soiled industrial laundry by initially contacting the heavily soiled industrial laundry with a concentrated cleaning solvent/surfactant mixture and thereafter washing the laundry in water to form an emulsion in a manner which extracts both solvent and "soils" from the fabric, followed by breaking the emulsion to separate the solvent from the water to thereby recycle the solvent for one or more additional cleaning cycles.

BACKGROUND OF THE INVENTION AND PRIOR ART

Many industrial laundries are located in or near major towns and cities. By their nature they use and discharge substantial quantities of water. Most laundries depend on municipal water treatment plants to treat their effluent, often with limited or no pretreatment by the laundry.

Permissible levels of pollutants, such as oil and heavy metals, have grown increasingly low in recent years making it extremely difficult for many industrial laundries to comply with discharge permits.

Shop towels and mops generate the highest percentage of the oil and heavy metal pollutants that cannot be passed on to a muncipal sewage treatment plant. While the shop towels and mops typically comprise only 20% of the goods processed by the laundry, they may contribute more than 80% of the hydrocarbons and heavy metals in the laundry effluent water. Until now, a satisfactory resolution to this problem has not been found. Some laundries have been forced to install elaborate wastewater treatment facilities at great expense only to find that the cost of operation is prohibitive.

A few years ago a system was developed for cleaning shop towels which was known in the trade as the "Dual Phase System". In this process, an excess of organic solvent (Stoddard Solvent) was used in a first step as a dry cleaning step for removal of grease and oil. The excess solvent then was removed for recycle of the solvent. The towels were then washed in a conventional fashion and the wash water was sufficiently low in solvent that it could be dumped to the sewer for municipal sewage treatment. However, sufficient solvent was retained by the shop towels that touch-up dying of the towels in the water wash steps was difficult, if not impossible. This Dual Phase System resulted in satisfactory cleaning performance and removal of oil from the wastewater. However, the level of solvent carried by the solvent-treated towels going to a drying step was prohibitively high. Organic vapor emissions were unacceptable, resulting in a need for a special dryer recovery system designed to recover the solvent. This was deemed too expensive, and commercially, the process was abandoned.

As set forth in U.S. Pat. No. 3,473,175, it is well known in the dry cleaning industry to initially pre-soak textiles in a bath of pure organic solvent and only thereafter allow water to enter the cleaning apparatus for cleaning the fabric in an emulsion of water dispersed in an organic solvent, such as perchloroethylene. As set forth above, one of the major problems with this method of cleaning heavily soiled industrial laundry is in the separation of the cleaning solvent from the water since a high percentage of the cleaning solvent is left in the fabric. Consequently, careful and expensive stripping apparatus must be used to insure that the solvent stripped from the fabric does not enter the atmosphere in order to comply with EPA requirements and regulations.

One of the most serious drawbacks of prior art methods and apparatus for cleaning heavily soiled industrial laundry is that a large excess of cleaning solvent is used beyond that which is necessary to soak the soiled laundry and, in addition, substantial quantities of water are mixed with this cleaning solvent in order to provide the number of wash cycles necessary to achieve the desired cleaning effect, resulting in serious problems in separating the solvent from the water. In accordance with the present invention, the soils from heavily soiled industrial laundry are removed and concentrated in small amounts of water and small amounts of solvent so that the separation procedure is unexpectedly more efficient for recycle of solvent to the cleaning operation than was possible in extant methods and apparatus while allowing water from the water wash cycles to be dumped to the sewer for municipal sewage treatment.

SUMMARY OF THE INVENTION

In brief, the method of the present invention is directed to initially contacting heavily soiled shop towels, mops and other industrial laundry with a mixture of a cleaning solvent and an emulsifier to efficiently penetrate the industrial soil in the fabric and thereafter adding water to provide an oil-in-water emulsion cleaning composition which effectively removes both the industrial soil and the solvent from the goods. The oil-in-water emulsion thereafter is demulsified for separation of the cleaning solvent from the water and recycle of the solvent to the process.

The methods of the present invention provide a system for cleaning shop towels, mops and other heavily soiled textiles that offer the following advantages over current methods:

(a) Provide superior cleaning as measured by appearance, extractibles and odor.

(b) Reduce the wastewater needing pretreatment (treatment prior to sewer dumping) to only a portion of that used in cleaning the shop towels or most severely soiled goods. Water requiring pretreatment usually is less than twenty percent of the water used at the laundry.

(c) Reduce the water required for a normal cleaning cycle by a factor of three to four.

(d) Facilitate removal and environmentally safe disposal of oils, grease and heavy metals so that the discharge water is acceptable for handling in a municipal water treatment plant.

(e) The cleaning process can be conducted at temperatures substantially lower than conventional cleaning methods improving safety and reducing energy costs.

(f) Increase productivity by reducing machine time.

(g) No major modifications are required to conventional washing and drying equipment.

The above advantages can be obtained while working with environmentally safe materials using operating conditions which are less hazardous to operating personnel and without adding prohibitive costs.

This process is carried out by thoroughly wetting the shop towels, mops or other heavily soiled textiles with an organic cleaning solvent in a washing apparatus while providing a minimum amount of solvent (not significantly greater than the amount necessary to saturate the textiles) together with a small amount of surfactant, e.g., about 0.5% to about 2.0% based on the weight of solvent, that will thoroughly wet the heavily soiled laundry without a significant excess of solvent. Higher amounts can be used without advantage. The solvent and emulsifier are selected such that when water is added for a subsequent wash cycle, the solvent is easily emulsified.

After the saturation cycle with solvent and surfactant, water is added, in an amount of about 700% to about 1500% based on the dry weight of the soiled laundry, and the composition is agitated or mixed to provide a solvent-in-water emulsion and the laundry is washed in this emulsion as a first water wash step. The wash apparatus is then drained. A second low level water wash step is then carried out into which an alkaline salt such as sodium metasilicate is added in an amount from less than about 1% to about 5%. This alkaline wash aids in removal of residual solvent and those soils that did not respond to the previous solvent emulsion wash.

Following this second water-wash step, the residual solvent and water are removed from the laundry, such as by spinning and draining, for separation of the solvent from the water. Optionally, the laundry can be washed again with water for one or more low level rinse steps, if required. The heavily soiled laundry so treated is now substantially free of residual solvent and may be dried in standard drying equipment without using solvent-vapor receiver apparatus to prevent solvent from entering the atmosphere, without risk of fire, and without significant solvent loss.

Accordingly, an object of the present invention is to provide a new and improved method of cleaning heavily soiled fabrics containing organic soils, such as oils or greases, that reduces the quantity of wastewater that requires treatment prior to dumping the wastewater to a sewer for treatment by a municipal water treatment facility.

Another object of the present invention is to provide a new and improved method of cleaning heavily soiled fabrics that requires much less water to achieve an acceptable degree of cleaning than prior art methods.

Another object of the present invention is to provide a new and improved method of cleaning heavily soiled fabrics capable of removing oils and greases with terpene solvents and terpene solvent emulsions.

Still another object of the present invention is to provide a new and improved method of cleaning heavily soiled textiles that is capable of acceptable cleaning at temperatures substantially lower than conventional cleaning methods thereby improving safety and reducing energy costs.

Another object of the present invention is to provide a new and improved method of cleaning heavily soiled industrial laundry in conventional cleaning apparatus that substantially increases productivity by reducing the cleaning time needed to provide cleaner laundry than conventional methods.

A further object of the present invention is to provide a new and improved method of cleaning heavily soiled industrial laundry using a minimum of cleaning solvent that is non-toxic and is more efficiently recycled for re-use in the process.

BRIEF DESCRIPTION OF THE DRAWING

The above and other objects and advantages of the present invention will become more apparent from the following detailed description of the preferred embodiment, taken in conjunction with the drawings, wherein.

DETAILED DESCRIPTION OF THE PREFERRED EMBODIMENT

Figure 1:
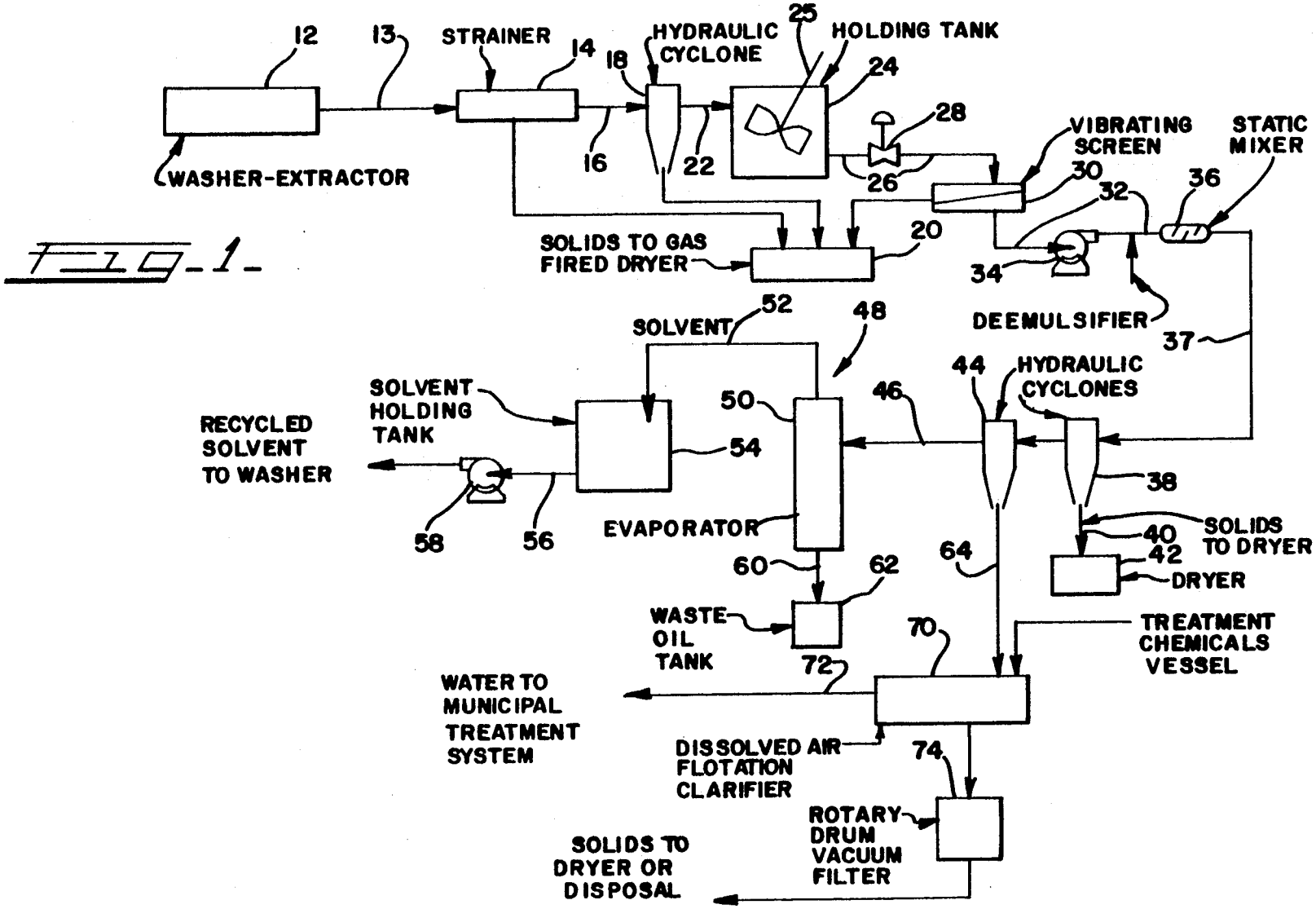
FIG. 1 is a schematic drawing of one embodiment of a wash water pretreatment cycle for treating wash water recovered from the method of the present invention prior to sending the wash water to a sewer for municipal wastewater treatment.

The shop towels, mops or other heavily soiled textiles are loaded into a typical dry cleaning washer (shown schematically) and then thoroughly wet (not significantly beyond the point of saturation) with a suitable solvent and a surfactant or mixture of surfactants. While this step may be carried out at room temperature, injection of steam has been found to improve penetration of the solvent into the oils and greases contaminating the towels. As a safety measure, the steaming should not elevate the temperature of the load above the flash point of the solvent used.

Any of a number of hydrocarbon solvents may be suitable for this step. A preferred class of hydrocarbon solvents suitable for this purpose is the class of solvents known as terpene solvents. Particularly suitable are terpene solvents having a tagg closed cup flash point, of 140° F. or higher. Such solvents substantially reduce the risk of explosion and flash fires, known hazards for solvent cleaning processes. These terpene solvents may be, for example, the products derived from pine trees or from citrus extracts. The terpene solvents useful in accordance with the present invention can be open chain (acyclic) terpenes and/or cyclic terpenes and include the sesquiterpenes, diterpenes, triterpenes, and the like. Examples of suitable terpenes include myrcene ($C_{10}H_{16}$); ocimene ($C_{10}H_{16}$); α-farnesene ($C_{15}H_{24}$); squalene ($C_{30}H_{50}$); lycopene ($C_{40}H_{56}$); limonene ($C_{10}H_{16}$); sylvestrene ($C_{10}H_{16}$); zingaberene ($C_{15}H_{24}$); λ-carotene ($C_{40}H_{56}$); -carotene ($C_{40}H_{56}$); sabinene ($C_{10}H_{16}$); α-pinene ($C_{10}H_{16}$); camphene ($C_{10}H_{16}$); β-selinene ($C_{15}H_{24}$); caryophyllene ($C_{15}H_{24}$); vetivazulene ($C_{15}H_{18}$); tricyclene ($C_{10}H_{16}$); bisabolene ($C_{15}H_{24}$) and cedrebe ($C_{15}H_{24}$). Other useful terpene solvents include the oxygen derivatives of terpenes, e.g., the alcohol derivatives, such as geraniol, nerol, linalool, menthol, phytol, vitamin A, farnesol and isoborneol; the aldehyde derivatives, such as geranial (citrol b), neral (citral a), and citronellal; acid derivatives, such as abietic acid, and 1,8-cineole; ascaridole; camphor; thujone; verbenone; and ketone derivatives such as menthone and fenchone; mixtures thereof and isomers of these compounds. Any of these terpene compounds that are solids under conditions of use can be solubilized with a suitable co-solvent, such as one or more liquid terpenes.

Specific examples of this family of solvents which have been shown to perform well are citrus-d-limonene, dipentene GICA and solvent 1500 manufactured by SCM Glidco Organics. A preferred solvent in this application is solvent 1500 which is a mixture of high boiling terpene alcohols. Although its degreasing characteristics are not necessarily better than the others, it has a higher flash point (164° F. TCC) than many of the other terpene solvents commercially available. The higher flash point provides an additional margin of operating safety in the industrial laundry.

The solvent should contain a suitable surfactant or mixture of surfactants selected on the basis of the solvent characteristics to render the solvent easily emulsified when water is added. The solvent-surfactant composition system can be said to be "self emulsifiable" because an oil-in-water emulsion will result upon addition of water in a subsequent water-wash cycle. Another criteria for selecting the surfactant is that the emulsion formed should cream easily or be readily broken at the later step when separation from the aqueous phase is required for subsequent recovery of the solvent for recycle.

A large number of cationic, anionic and nonionic oil-soluble surfactants or combinations thereof may be used which satisfy the above criteria. The following examples have been found to be particularly useful:

| TRADE NAME | CHEMICAL DESCRIPTION |
|---|---|
| POLYSTEP A-13 | alkyl benzene sulfonic acid-anionic, Stepan Co., Northfield, IL. |
| NINOL 201 | oleic acid based alkanolamide - nonionic |
| JORDAPHOS JE-41 | phosphate ester - anionic, Jordan Chemical Co., Folcroft, PA. |
| MONAMULSE 947 | alkyl aryl anionic. Mona Industries, Paterson, NJ. |
| MONAMULSE 653-C | modified alkanolamide - anionic/nonionic, Mona Industries, Paterson, NJ. |
| MONAMULSE CI | modified imidazoline - cationic, Mona Industries, Paterson, N.J. |
| MONAWET MO-70 | dioctyl sodium sulfosuccinate - anionic, Mona Industries, Paterson, NJ. |
| MONAZOLINE 0 | imidazoline of oleic acid - cationic, Mona Industries, Paterson, NJ. |
| MONAZOLINET | imidazoline of tall oil - cationic, Mona Industries, Paterson, NJ. |
| GAFAC RM-710<br>GAFAC RM-510<br>GAFAC PE-510<br>GAFAC RE-510<br>GAFAC RS-410 | polyoxyethylene dinonylphenol ether phosphate - anionic, GAF Corp., Wayne, NJ. |
| SILWET 1-77<br>SILWET L-7602 | silicone glycol copolymer - nonionic, Union Carbide Corp., Danbury, CT. |
| ALKAZINE TO | hydroxyethyl imadazoline - cationic, Alkaril Chemicals, Ontario, Canada |
| KEIL FM-40 | modified glyceryl monotallate - nonionic, Keil Chem. Div. Ferro Corp., Hammond, IN. |
| MACKAMIDE CD | cocamide DEA/nonionic, McIntyre Chem. Co., Ltd., Chicago, IL. |
| MIRAMINE OC | imideazoline of Oleic acid/cationic. Miranol Inc., Dayton, N.J. |
| MIRAMINE SC | imidazoline of Soya fatty acids/cationic, Miranol Inc., Dayton, N.J. |
| EMCOL 4580 PG | sulfosuccinate/anionic, Witco Corp., NY, NY. |
| EMCOL 4600 | sulfosuccinate/anionic, Witco Corp., NY, NY. |
| LEMPHOS CS-1361 | sodium nonoxynol-9 phosphate/anionic, Witco Corp., NY, NY. |
| WITCOLATE 1259 | alcohol ether sulfate/anionic, Witco Corp., NY, NY. |
| WITCONATE PLU-59 | amine salt of dodecylbenzene sulfonic acid/anionic. Witco Corp., NY, NY. |

If a nonionic surfactant is used, it should have an HLB number of about 1 to about 12, preferably about 3 to about 10 and ideally about 5 to about 10, so that the surfactant is sufficiently oil-soluble. Suitable nonionic surfactants having an HLB number of from about 1 to about 12 are exemplified in *McCutcheon's Emulsifiers and Detergents, North American Ed.*, 1987, pp. 287–301, herein incorporated by reference.

A preferred surfactant for use with terpene solvents was found to be Monamulse 947, an anionic phosphate ester blend produced by Mona Industries, Inc., Paterson, N.J. In general, anionic surfactants may be preferably since cationics may tend to bind to the cellulose in cotton fabrics and nonionic surfactants sometimes produce emulsions that are difficult to break.

The second step is to add water and do a low level wash, e.g., about 11 to about 18 gallons of water per 100 pounds of soiled laundry. For difficult to degrease materials, a few minutes (about 1 to about 5 minutes) of steaming may be beneficial before adding the water to speed the penetration of the solvent.

This is followed by a second low level wash step (again about 11 to about 18 gallons of water per 100 pounds of soiled laundry) into which sodium metasilicate or other alkaline salt is added to the emulsion at the level of from less than about 1% to about 5% based on weight of the laundry (dry basis). One skilled in the art of laundering will know that more than 5% alkali salt can be used but is generally not cost effective. Other conventional alkali salts, such as sodium sesquisilicate, sodium orthosilicate, and the corresponding salts of potassium are also particularly useful. This alkaline wash serves to aid in removal of residual solvent and those soils that do not respond to the preceding solvent bath (usually a minor part of the total).

After the water-alkali salt wash step, the process is followed by extraction and one or more additional rinse steps, if required. The clean towels then are essentially free of residual solvent and may be dried in standard equipment without risk of fire or significant solvent loss.

In practicing the method of the present invention, the first three effluents (from the concentrated solvent-/emulsifier wash; from the water-in-solvent emulsion wash; and from the water-alkali salt-solvent wash) are usually sent to holding tanks for a special pretreatment process. Under some conditions, generally related to the "soil" level of the goods prior to laundering, the number of effluents routed to the holding tanks may be decreased or increased.

The organic solvent phase then is distilled. Water and light hydrocarbon solvents from the soiled towels can be separated first based on the difference in boiling temperatures. In this manner, the cleaning solvent is recovered for recycle. The high boiling residue containing the contaminating oils, greases and heavy metal salts then can be concentrated for disposal in any environmentally acceptable way. For example, the hydrocarbon portion may be disposed of by incineration and the ash blended with a solid polymer or cement that will satisfy environmental requirements and not leach into groundwater.

A conventional wash in an 800 pound capacity wash wheel typically requires nine high level wash cycles, at 173 gallons of water each, and three low level wash cycles requiring 100 gallons of wash water each, for every 800 pounds of soiled laundry, totalling 230 gallons of wash water per 100 pounds of soiled laundry. The process of the present invention requires only about three or four high level wash cycles at 173 gallons of water each, and three low level wash cycles at 100 gallons of water each, thereby using less than half the water required by a conventional system. Furthermore, the contaminants are concentrated in the first half of the rinse water and only this portion requires pretreatment.

The aqueous phase may be treated using conventional methods and equipment especially designed for heavy metal ion removal, and the like prior to discharging to the numicipal treatment plant. Because most of the pollutants are concentrated in this small fraction of the total water used by the laundry, the cost of pretreatment is substantially reduced.

A schematic of one such composition pretreatment system is shown in FIG. 1. This system assumes that a non-toxic, emulsifiable solvent is used to wet out the shop towels before the wash water is added. It is also expected that one or at most two rinses will be sufficient to complete the cleaning. Each wash cycle would require approximately 100 gallons of solvent and a total of 300 gallons of water. The wastewater would be discharged from rinse wash wheel 12 of conventional dry cleaning apparatus through conduit 13 and strainer 14 to take out large pieces of paper, string and other foreign matter. The wash water would then pass through conduit 16 to a hydraulic cyclone 18 to remove the heavy solids, sand, grit, and the like. The solids from strainer 14 and hydrocyclone 18 would be dried in a gas fired dryer 20 and later landfilled. The wastewater would be passed through conduit 22 to an agitated holding tank 24 and kept mixed with agitator 25. From the holding tank 24 forward, the system would operate automatically and continuously. The water would be passed from the holding tank 24 through conduit 26 and valve 28 through a vibrating screen 30 to remove lint and small solids at a controlled rate and then through conduit 32 and pump 34 to a static mixer 36 where a demulsifier, such as sodium metasilicate, will be added.

The demulsifier should be selected in conjunction with the emulsifier used in the wash solvent to make the solvent-diluted oil emulsion break cleanly and with a minimum of chemical usage. The demulsified solvent and water is pumped through conduit 37 to hydraulic cyclone 38 for separating solids which are conveyed through conduit 40 to a dryer 42. A second hydraulic cyclone 44 should be sufficient to separate the oil-solvent phase from the water and to remove most of the suspended solids. An alternative to be considered here is a fibrous bed coalescer (not shown). The oil-solvent phase is passed through conduit 46 to a packaged continuous solvent recovery unit, generally designated by reference numeral 48. Solvent recovery unit 48 includes an evaporator 50 wherein solvent is vaporized and conveyed through conduit 52 to solvent holding tank 54 for recycle of solvent, via conduit 56 and pump 58, to the wash wheel 12. The recovered solvent has make-up surfactant added and is recycled to the next wash. Waste oil is collected as a bottoms material through conduit 60 from evaporator 50 in drums and sent to a waste oil incinerator 62.

If metals are a problem, the wash water from hydrocyclone 44 is passed through conduit 64 to a precipitation vessel 70 wherein treatment chemicals are added for metals precipitation, as well known in the art. Water is discharged from the precipitation vessel 70 and sent to a municipal, water treatment plant through a conduit 72. The precipitated metals and other precipitates and recovered solids are removed from the precipitation vessel 70 through conduit 76 and then are dried. It is expected that the unit would be required to process only 2 to 3 thousand gallons of fluid per day and it would be relatively small.

EXAMPLE 1

Into a MILNOR 35 pound washer/extractor were placed a total of thirty-five pounds of heavily soiled shop towels. The first step was to saturate the towels with 35 pounds of dipentene solvent (SCM GICA) which contained 1% by weight of Jordaphos JE 41 phosphate ester surfactant. The steps in the wash procedure are shown in TABLE 1. Rinses 4, 5 and 6 were clear and essentially free of organics. These were sent to the drain. Materials from the first three steps were retained for treatment. The organic phase was separated by gravity and later reclaimed by distillation in a batch Yacuum still. A material balance for the distillation is shown in TABLE 2.

The aqueous phase from the first three steps was collected and weighed. Total weight was 355.5 pounds, the weight of organic material present in this water was 0.47%. This indicated a net recovery of 95.17% of solvent of which 98.6% was reclaimed from the distillation for an overall recovery of 93.8% of the solvent.

The wet shop towels were then placed in a gas fired dryer. When the towels were dry they appear much cleaner than towels washed in a conventional manner. The towels were free of odor except for a faint pine scent. Extraction data (TABLE 3) confirmed the towels to be much cleaner than is now standard in the industry.

The following terms used to describe the various wash cycles for the method of the present invention are standard in the industry and well known to those skilled in the art:

Flush—water is introduced into the wash wheel at start up and run for 2 to 3 minutes, then discharged. The purpose is to flush as much loose and water-soluble soil from the goods as possible before introducing any chemicals.

Break—that wet operation in which chemicals (alkali and detergents) are added to remove soil, grease, and the like from the soiled laundry.

Suds—a second break usually run at low level, e.g., 100 gallons water per 800 pounds of soiled laundry, and with about one half the amount of chemicals used in a break cycle.

Extract—a step in which water is mechanically removed from the laundry, usually by centrifugal force.

Low level—a level of water in a wash wheel usually associated with a flush, a suds or a carry over. Typically 6 to 8 inches (100 gallons) in a conventional machine.

High level—a level of water in a wash wheel usually associated with rinse operations. Typically 12 inches (173 gallons) in a conventional machine.

Carry over (C.O.)—a wet operation just after the break. Usually run at low level to take advantage of residual detergent and alkali in the goods to enhance cleaning.

TABLE 1

| | SAMPLE # | OPERATION | LEVEL | °F. | TIME | SUPPLIES/35* Lb LD |
|---|---|---|---|---|---|---|
| | | Saturate | | | 5 | 35 Lbs blend #5 |
| ↑ | 1 | Break | Low | 120 | 15 | — |
| ↑ | 1-E | Drain | — | — | 1 | — |
| ↑ | | Extract | — | — | 3 | — |
| ↑ | 2 | Break | Low | 160 | 8 | 317 grams $Na_2SiO_3$ |
| ↑ | | Drain | — | — | 1 | — |
| ↑ | 3 | C.O. | Low | Hot | 5 | — |
| To holding | 3E | Drain | — | — | 1 | — |
| tanks | | Extract | — | — | 3 | — |
| ↑ | 4 | Rinse | High | 140 | 3 | |
| ↑ | | Drain | — | — | 1 | |
| ↑ | 5 | Rinse | High | 140 | 2 | |
| ↑ | | Drain | — | — | 1 | |
| ↑ | 6 | Rinse | High | 120 | 2 | |
| ↑ | | Drain | — | — | 1 | |
| To sewer | 7 | Extract | — | — | 3 | |

*Soiled wgt.

TABLE 2

DISTILLATION RESULTS

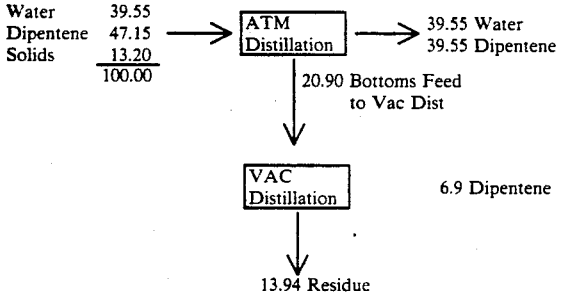

Dipentene 39.55
6.96
46.51

$\frac{46.51}{47.15}$ = 98.6% Recovery (95.17%) × (98.6%) = 93.8% net recovery

TABLE 3

CLEANING RESULTS
Run #15A

| | Before | Extractions* After | % Ext. |
|---|---|---|---|
| 1. | 40.0551 | 38.7512 | 3.4 |
| 2. | 41.4001 | 39.8401 | 3.9 |
| 3. | 41.4323 | 40.2047 | 3.1 |

TABLE 3-continued

CLEANING RESULTS
Run #15A

| Before | Extractions* After | % Ext. | |
|---|---|---|---|
| 122.8875 | 118.7960 | 3.5 | Actual average |

Industry standard = 8%

*Extractions were determined by the use of the industry accepted procedure of removing the oils and greases and other solvent soluble "soils" from the towel specimens by refluxing for three hours with Hexane solvent in a Soxhlet extractor.

EXAMPLE 2

Preparation of Solvent/MONAMULSE 947

Thirty-five pounds of Solvent 1500 were weighed, at room temperature, into a 5 gallon plastic container. To this solvent, was added, as received, 2% of MONAMULSE 947. (Actual amount of active MONAMULSE 947=(35) (0.02) (453.6)=317.5 grams). The mixture was vigorously stirred for about 5 minutes. After standing for about 15 minutes, the mixture was restirred.

In a separate container, 317.5 grams of DRYMET (sodium metasilicate) was placed and set aside for use in the laundering cycle shown below.

Preparation for Laundering: A 35 Lb. MILNOR washwheel was loaded with 35 pounds (preweighted) of the soiled towels. (Special effort was made to remove the 35 Lbs. of towels from their container at random, i.e., to insure that no extra dirty or extra clean towels were picked to the exclusion of other differently soiled towels.)

The door of the washer was then closed and the wheel was started:

Processing Formula

| | Operation | Level | Time (min.) | °F. | Supplies/35 lb. Load |
|---|---|---|---|---|---|
| #1 | Saturate | — | 5/0 | Room | 35 lb. 1500/Mona 947-2% |
| | Break | Low | 15/1 | 120 | Above sol. blend |
| | Extract | — | 2 | — | — |
| #2 | Carry-over | Low | 5/1 | 120 | None |
| | Extract | — | 2 | — | — |
| #3 | Break | Low | 8/1 | 160 | 2% Drymet crystals |
| | Extract | — | — | 1 | |
| #4 | Rinse | High | 3/1 | 140 | None |
| #5 | Rinse | High | 2/1 | 140 | None |
| #6 | Rinse | High | 2/1 | 120 | None |
| | Extract | — | 4 | — | — |

Dried at 190° F./20 minutes/5 minutes cool down. Unload, sample (50) and store remainder)

Sampling: After each step, sample effluents were collected and identified according to the numbers opposite the line items of the above formula.

Fifty towels were pulled "blind" from the batch and forwarded to the laboratory for determination of cleanliness level. Results are shown in TABLE 4.

TABLE 4

EXAMPLE 2/Solvent 1500

Laboratory tests were performed on 40 randomly "selected" towels from EXAMPLE 2 with the objective of determining the cleanliness thereof after processing with Solvent 1500.

Solvent Solubles—40 towels—5.9%

Results of the aqueous phase analysis for EXAMPLE 2 are shown in TABLE 5.

TABLE 5

AQUEOUS PHASE ANALYSIS EXAMPLE 2

| SAMPLE # | PPM OIL | PPM LEAD (PPM) |
|---|---|---|
| 1 | 220 | 2.6 |
| 2 | 280 | .53 |
| 3 | 540 | 1.75 |
| 4 | 610 | .38 |
| 5 | 560 | .30 |
| 6 | 102 | .17 |

EXAMPLE 3

Conventional Process

| Operation | Level | °F. | Time | Supplies/ 800 lb. Load |
|---|---|---|---|---|
| Flush | 12" (1) | 150 | 2/1 (2) | None |
| Break | 6" (3) | 170 | 15/1 | See note (4) |
| Flush | 12" | 150 | 3/1 | |
| Flush | 12" | 150 | 2/1 | |
| Sids | 6" | 170 | 8/1 | See note (5) |
| Rinse | 12" | 150 | 2/1 | |
| Rinse | 12" | 150 | 2/1 | |
| Rinse | 12" | 150 | 2/1 | |
| Rinse | 12" | 140 | 2/1 | |
| Dye | 6" | 130 | 7/1 | See note (6) |
| Rinse | 12" | 80 | 2/1 | |
| Sour | 12" | 80 | 5/1 | See note (7) |
| Extract/ Dry | | | | |

Notes:
(1) In a 12" water level - 800 lb. wheel - water volume is 173 gallons when goods are saturated. To saturate = (800) (.3) = 240 gallons.
(2) Under time, these fractions denote, using 2/1 as example, 2 minutes running time, 1 minute drain.
(3) A 6" water level, same wheel, equals 100 gallons of water.
(4) Supplies: 3% sodium metasilicate, 0.75% nonionic detergent, both based on weight of towels in load.
(5) Supplies: 2% metasilicate, 0.50% nonionic detergent.
(6) In 800 lb. wheel, about 4 packs (8 oz./each) of a direct dye.
(7) 8 ozs. of sodium silicofluoride to neutralize residual alkali.

The above conventional method will use approximately 1,859 gallons of water and produce a towel having, on average, about 5.5% residual oils/greases.

The runs described in EXAMPLES 4, 5 and 7 in the following pages were made in a 35 lb. Milnor and the numbers are up-scaled to an 800 lb. wheel for the purpose of direct comparison:

EXAMPLE 4

| Operation | Level | Time | °F. | Supplies/ 800 lb. Load |
|---|---|---|---|---|
| Saturation | — | 5/0 | S-160 (1) | See Note (2) |

-continued

| Operation | Level | Time | °F. | Supplies/ 800 lb. Load |
|---|---|---|---|---|
| Break #1 | 12" | 10/1 | 160 | |
| Extract | — | 1/2 | — | |
| Break #2 | 12" | 10/1 | 160 | See Note (3) |
| Rinse | 12" | 2/1 | 160 | |
| Rinse | 12" | 2/1 | 160 | |
| Rinse | 12" | 2/1 | 140 | |
| Extract | — | 1/2 (4) | — | |
| Rinse | 12" | 2/1 | 120 | |
| Extract | — | 1/4 | — | |
| Dry | | | | |

Notes:
(1) Since solvent is "cold", (S) steam is introduced to raise the wash temperature to 160° F.
(2) 800 lbs. Solvent 1500 (SCM) containing 16 lbs. dissolved MONAMULSE 947 (an anionic emulsifier).
(3) 2% (16 lbs.) of sodium metasilicate.
(4) This fraction denotes two speeds of extraction, the first digit is an intermediate speed, the second digit is a high speed.

The process of EXAMPLE 4 will use approximately 1,158 gallons of water (compared to 1,859 gallons used in the conventional process of EXAMPLE 3). Residual oils/greases are 3.2% (compared to 5.5% conventional method) and a wick rate of about 70 seconds (compared with 90 seconds, conventional).

EXAMPLE 5

| Operation | Level | Time | °F. | Supplies/800 lb. Load |
|---|---|---|---|---|
| Saturate | — | 5/0 | S-160 | See note (1) |
| Break | 12" | 15/1 | 170 | See note (2) |
| Extract | — | 1/3 | — | |
| Carry Over | 12" | 5/1 | 150 | None |
| Extract | — | 1/3 | — | |
| Det. Rinse | 12" | 5/1 | 140 | See note (3) |
| Extract | — | 1/2 | — | |
| Rinse | 12" | 3/1 | 130 | |
| Extract | — | 1/4 | — | |
| Dry | | | | |

Notes:
(1) 800 lbs. Solvent 1500 containing 8 lbs. of MONAMULSE 947.
(2) 24 lbs. sodium metasilicate.
(3) 32 ozs. nonionic detergent, such as TERGITOL 15-S-9

This process produced towels with 4.2% residual oils/greases.

The process of this invention works well for the processing of printer towels. To illustrate the significance, a conventional printer towel formula is shown below for an 800 lb. wheel in EXAMPLE 6:

EXAMPLE 6

Printer Towels—Conventional Method

| Operation | Level | Time | °F. | Supplies/800 lbs. Load |
|---|---|---|---|---|
| Flush | 12" | 2/1 | 120 | — |
| Flush | 12" | 2/1 | 160 | |
| Break | 6" | 15/1 | 180 | See note (1) |
| Rinse | 12" | 2/1 | 180 | |
| Rinse | 12" | 2/1 | 180 | |
| Break | 6" | 10/1 | 180 | See note (2) |
| Rinse | 12" | 2/1 | 180 | |
| Rinse | 12" | 2/1 | 180 | |
| Break | 6" | 7/1 | 180 | See note (3) |
| Rinse | 12" | 2/1 | 180 | |
| Rinse | 12" | 2/1 | 160 | |
| Rinse | 12" | 2/1 | 160 | |
| Rinse | 12" | 2/1 | 160 | |
| Rinse | 12" | 2/1 | 160 | |
| Rinse | 12" | 2/1 | 120 | |
| Rinse | 12" | 2/1 | 120 | |
| Rinse | 12" | 2/1 | 120 | |

-continued

| Operation | Level | Time | °F. | Supplies/800 lbs. Load |
|---|---|---|---|---|
| Extract/Dry | | | | |

Notes:
(1) 35 lbs. sodium orthosilicate. 24 ozs. nonionic detergent. 96 ozs. Solvated nonionic detergent.
(2) 20 lbs. sodium orthosilicate. 48 ozs. Solvated nonionic detergent.
(3) 15 lbs. sodium orthosilicate. 24 ozs. Solvated nonionic detergent.

This procedure renders printer towels virtually free of pigment stains and solvent soluble soils (1%). Water consumption is 2,962 gallons of water.

In comparison with the conventional method, a load of printer towels was run in a 35 lb. MILNOR and up-scaled below for an 800 lb. wheel, as shown in EXAMPLE 7.

EXAMPLE 7

| | Printer Towels | | | |
|---|---|---|---|---|
| Operation | Level | Time | °F. | Supplies/800 lb. Load |
| Flush | 12" | 3/1 | cold | None |
| Flush | 12" | 3/1 | cold | None |
| Solvent break | 12" | 10/1 | 150 | See note (1) |
| Extract | — | 1/4 | — | |
| Break | 6" | 10/1 | 170 | See note (2) |
| Carry over | 6" | 5/1 | 160 | None |
| Extract | — | 1/2 | — | |
| Rinse | 12" | 2/1 | 160 | None |
| Rinse | 12" | 2/1 | 160 | None |
| Rinse | 12" | 2/1 | 120 | None |
| Extract | — | 1/4 | — | |
| Dry | | | | |

Notes:
(1) 800 lbs. SOLVENT 1500 containing 16 lbs. dissolved MONAMULSE 947.
(2) 24 lbs. sodium orthosilicate.

This process produced towels free of pigment stains, having 2.1% solvent solubles. Water consumption was 1,358 gallons (compared with 2,962 gallons by the conventional method of EXAMPLE 6).

Many modifications and variations of the present invention are possible in light of the foregoing specification and thus, it is to be understood that within the scope of the appended claims, the invention may be practiced otherwise than as specifically described.

What is claimed and desired to be secured by Letters Patent of the United States is:

1. A method of cleaning heavily soiled textiles with a mixture of at least one of a cyclic and acyclic hydrocarbon terpene solvent and at least one of an oil-soluble anionic, an oil soluble nonionic and an oil-soluble cationic surfactant having an HLB number of about 1 to about 10, said mixture containing the surfactant in an amount from about 0.5 to about 2.0 percent by weight of solvent, said method comprising the steps of:

soaking the heavily soiled textiles in an amount of said solvent/surfactant mixture sufficient substantially to saturate the textiles with said mixture;

forming a solvent-in-water emulsion in contact with said soiled textiles by adding water to said mixture-saturated textiles only in an amount sufficient to form a solvent-water emulsion and by agitating the soiled textiles, the solvent/surfactant mixture and the added water together;

effecting a first low water level wash step by adding a low volume of water to said solvent-in-water emulsion and agitating the soiled textiles therein to separate a substantial portion of the soil from the textiles such that the soil forms a part of the solvent-in-water emulsion;

separating the washed textiles from a major portion of the solvent-in-water emulsion from the first wash step;

effecting a second low water level wash step by adding a low volume of an aqueous alkaline salt solution to the washed textiles and agitating the washed textiles and aqueous alkaline salt solution to remove a substantial portion of the solvent remaining from with the textiles from the first wash step and for additional soil removal therefrom; and separating the textiles from a major portion of the solvent and water from said second wash step to achieve textiles substantially free of solvent.

2. The method of claim 1 in which the amount of surfactant to the organic solvent/surfactant mixture required to saturate the soiled textile is about 0.5% to about 2.0% based on weight of solvent.

3. The method of claim 1 wherein the anionic surfactant is a phosphate ester.

4. The method of claim 1 wherein the solvent is one of a terpene and a dipentene.

5. The method of claim 1 and the step of recovering the solvent for reuse by separating the solvent from the water from the first and second wash steps.

6. The method of claim 1 wherein the solvent is one of a sequiterpene and a triterpene.

7. The method of claim 1 wherein the solvent comprises a terpene alcohol.

8. The method of claim 4 wherein the terpene is selected from the group consisting of mycene($C_{10}H_{16}$); ocimene($C_{10}H_{16}$); α-farnesene($C_{15}H_{24}$); squalene($C_{30}H_{50}$); lycopene($C_{40}H_{56}$); limonene($C_{10}H_{16}$); citrus-d-limonene; sylvestrene($C_{10}H_{16}$); zingaberene($C_{15}H_{56}$); λ-carotene($C_{40}H_{56}$); carotene($C_{40}H_{56}$); sabinene($C_{10}H_{16}$); α-pinene($C_{10}H_{16}$);camphene($C_{10}H_{16}$), β-selinene($C_{10}H_{24}$); carophyllene($C_{15}H_{24}$); vetivazulene($C_{15}H_{18}$); tricyclene($C_{10}H_{16}$); bisabolene($C_{15}H_{24}$); cedrene($C_{15}H_{24}$); geraniol; nerol; linalool; menthol; phytol: vitamin A; farnesol; isobornol; geranial; neral; citronellal; abietic acid; 1,8-cineole; ascaridole; camphor; thujone; vergenone; methone; fenchone; other oxygen derivatives of terpenes; other alcohol derivatives of terpenes; other aldehyde derivatives of terpenes; and mixtures thereof.

9. The method of claim 1 wherein the alkaline salt contained in the second wash step is a metal silicate.

10. The method of claim 9 wherein the alkaline salt is selected from the group consisting of a metal silicate, a metal sesquisilicate, a metal orthosilicate, and mixtures thereof.

11. The method of claim 10 wherein the metal of the metal salt one of sodium and potassium.

12. The method of claim 9 wherein the alkaline salt is contained in the second wash step in an amount of about 1% to about 5% based on the weight of solvent.

13. The method of claim 1 further including the step of steaming the textile while saturated with solvent-/emulsifier mixture, prior to adding water for a wash step.

14. The method of claim 1 wherein the solvent has a flash point of at least 140° F.

15. A method of cleaning heavily soiled textiles with a mixture of one of an acyclic terpene, a cyclic terpene, an acyclic dipentene and a cyclic dipentene with one of an oil-soluble anionic surfactant, an oil-soluble nonionic surfactant and an oil-soluble cationic surfactant having an HLB number about 1 to about 12, said mixture containing the surfactant in an amount from about 0.5 to about 2.0 percent by weight of solvent, said method comprising the steps of;

soaking the heavily soiled textiles in an amount of the solvent/surfactant mixture sufficient to substantially saturate the textiles with said mixture sufficient to substantially saturate the textiles with said mixture without substantial excess of solvent/surfactant beyond saturation;

forming a solvent-in water emulsion in contact with said soiled textiles by adding water to said mixture saturated textiles in an amount only sufficient to form said solvent-in water emulsion and agitating the soiled textiles solvent/surfactant mixture and water together;

effecting a first low water level wash step containing no more than about 125 gallons of water per 800 pounds of soiled textiles by adding said water and agitating said soiled textiles by adding said water and agitating said soiled textiles in said solvent-in-water emulsion to separate a substantial portion of the soil from the textiles with the soil forming a part of the solvent-in-water emulsion;

textiles with a mixture of one of an acyclic terpene, a cyclic terpene, an acyclic dipentene and a cyclic dipentene with one of an oil-soluble anionic surfactant, an oil-soluble non-ionic surfactant and an oil-soluble cationic surfactant having an HLB number about 1 to about 12, said mixture containing the surfactant in an amount by weight of solvent from about 0.5 to about 2.0 percent by weight of solvent, said method comprising the steps of;

soaking the heavily soiled textiles in an amount of the solvent/surfactant mixture sufficient to substantially saturate the textiles with said mixture sufficient to substantially saturate the textiles with said mixture without substantial excess of solvent/surfactant beyond saturation;

forming a solvent-in-water emulsion in contact with said soiled textiles by adding water to said mixture saturated textiles in an amount only sufficient to form said solvent-in-water emulsion and agitating the soiled textiles solvent/surfactant mixture and water together;

effecting a first low water level wash step containing no more than about 125 gallons of water per 800 pounds of soiled textiles by adding said water and agitating said soiled textiles by adding said water and agitating said soiled textiles in said solvent-in-water emulsion to separate a substantial portion of the soil from the textiles with the soil forming a part of the separating the washed textiles from a major portion of the solvent-in-water emulsion from the first wash step;

effecting a second low water level wash step by agitating the washed textiles with an aqueous alkaline salt solution a substantial portion of the solvent remaining with the textiles from the first wash step and for additional soil removal;

separating the washed textiles from a major portion of the solvent and water of the second wash step; and washing the second washed textiles in a third water wash step to achieve cleaned textiles substantially free of solvent.

16. The method of claim 1 wherein the surfactant is added after the solvent.

17. The method of claim 1 wherein the surfactant is added with the water.

18. The method of claim 15 and the steps of: separating the solvent from the water obtained from the three wash steps for reuse of the solvent, and washing the textile in at least one more additional wash step without significant additional solvent removal so that wash water recovered can be conveyed to a water treatment plant without pretreatment.

19. The method of claim 15 in which the volume of water added to each of the first and second low water level wash steps is 100 gallons per 800 pounds of dry soiled textiles.

20. The method of claim 8 wherein the surfactant is selected from the group consisting of of alkyl benzene sulfonic acid, oleic acid based alkanolamide, phosphate ester, modified alkanolamide, modified imidazoline, dioctyl sodium sulfosuccinate, imidazoline of oleic acid, imidazoline of tall oil, polyoxyethylene dinonylphenol ester phosphate, silicone glycol copolymer, hydroxyethyl imadazoline, modified glyceryl monotallate, cocimide DEA, imideazoline of oleic acid, imidazoline of soya fatty acids, sulfosuccinate, sodium nonoxynol-9 phosphate, alcohol ether sulfate and an amine salt of dodecylbenzene sulfonic acid.

21. The method of claim 15 wherein the terpene is selected from the group consisting of of mycene ($C_{10}H_{16}$), ocimene ($C_{10}H_{16}$), $\alpha$-farnesene ($C_{15}H_{24}$), sylvestrene ($C_{10}H_{16}$), limonene ($C_{10}H_{16}$), citrus-d-limonene, $\lambda$-carotene ($C_{40}H_{56}$), carotene ($C_{40}H_{56}$), squalene($C_{30}H_{50}$), lycopene ($C_{40}H_{56}$), sabinene ($C_{10}H_{16}$), $\alpha$-pinene($C_{10}H_{16}$), camphene ($C_{10}H_{16}$), $\beta$-selinene($C_{10}H_{24}$), caryophyllene($C_{15}H_{24}$), vetivazulene($C_{15}H_{18}$), tricyclene($C_{10}H_{16}$), bisabolene($C_{15}H_{24}$), cedrene($C_{15}H_{24}$), geraniol, nerol, linalool, menthol, phytol, vitamin A, farnesol, isoborneol, geranial, neral, citronellal, abietic acid, 1,8-cineole, ascaridole, camphor, thujone, verbenone, methone, fenchone, other oxygen derivatives of terpenes, other alcohol derivatives of terpenes, other ketone derivatives of terpenes, and mixtures thereof.

* * * * *